US008330572B2

(12) United States Patent
Rodriguez et al.

(10) Patent No.: US 8,330,572 B2
(45) Date of Patent: Dec. 11, 2012

(54) MULTIPLE BARRIER CONTROL SYSTEM

(75) Inventors: Yan Rodriguez, Suwanee, GA (US); James S. Murray, Glendale Heights, IL (US)

(73) Assignee: Homerun Holdings Corporation, Pensacola, FL (US)

( * ) Notice: Subject to any disclaimer, the term of this patent is extended or adjusted under 35 U.S.C. 154(b) by 992 days.

(21) Appl. No.: 11/724,941

(22) Filed: Mar. 16, 2007

(65) Prior Publication Data

US 2008/0224886 A1 Sep. 18, 2008

(51) Int. Cl.
*G08C 19/14* (2006.01)

(52) U.S. Cl. ..... 340/5.71; 340/5.7; 340/13.28

(58) Field of Classification Search ..... 340/5.7, 340/5.71, 531, 539.1, 825.72, 5.26, 510, 340/5.72, 5.22, 5.61, 5.62, 5.63, 5.64; 455/66.1, 455/344

See application file for complete search history.

(56) References Cited

U.S. PATENT DOCUMENTS

| | | | | |
|---|---|---|---|---|
| 4,712,104 | A * | 12/1987 | Kobayashi | 340/825.52 |
| 5,949,407 | A | 9/1999 | Sato | 345/169 |
| 6,326,754 | B1 | 12/2001 | Mullet et al. | 318/480 |
| 6,624,605 | B1 | 9/2003 | Powder et al. | 318/445 |
| 6,915,146 | B1 * | 7/2005 | Nguyen et al. | 455/702 |
| 6,975,203 | B2 | 12/2005 | Brookbank et al. | 340/5.26 |
| 6,998,977 | B2 * | 2/2006 | Gregori et al. | 340/505 |
| 2005/0232694 | A1 | 10/2005 | Fitzgibbon | 404/6 |
| 2005/0253731 | A1 * | 11/2005 | Fitzgibbon et al. | 340/691.6 |
| 2005/0272372 | A1 | 12/2005 | Rodriguez | 455/66.1 |
| 2006/0021714 | A1 * | 2/2006 | Carmen et al. | 160/120 |
| 2006/0103503 | A1 | 5/2006 | Rodriguez | 340/5.71 |
| 2006/0202815 | A1 * | 9/2006 | John | 340/531 |
| 2007/0063815 | A1 * | 3/2007 | Tsui et al. | 340/5.71 |

* cited by examiner

*Primary Examiner* — Nabil Syed
(74) *Attorney, Agent, or Firm* — Renner Kenner Greive Bobak Taylor & Weber

(57) ABSTRACT

A multiple barrier control system includes a plurality of barrier operators configured to move associated access barriers between limit positions. Each of the barrier operators are enabled to communicate with one or more local transmitters. The local transmitters may maintain an all-close button, an all-open button, and an all-stop button, which are associated with corresponding functions maintained by the barrier operators. Upon the actuation of one of the buttons, the associated function is simultaneously carried out by each of the associated barrier operators. Additionally, a portable network control may invoke the simultaneous control of functions at each of the barrier operators via an associated communication network. Moreover, scenes may be created wherein the barrier operators and other accessories, such as lights and appliances, may be moved or actuated to a desired status upon actuation of a scene button on either the local transmitter or the portable network control.

23 Claims, 8 Drawing Sheets

MULTIPLE BARRIER CONTROL SYSTEM

TECHNICAL FIELD

Generally, the present invention relates to one or more transmitters each configured to be learned with a plurality of barrier operators so as to simultaneously control a feature maintained thereby. Specifically, the present invention relates to one or more transmitters that are configured to simultaneously open, close, or stop each of the access barriers associated therewith. More specifically, the present invention is directed to one or more network devices enabled to simultaneously open, close, or stop the movement of one or more associated access barriers via a communication network.

BACKGROUND

Typical residential barrier operators used to move an access barrier between opened and closed positions are configured only to be responsive to a "change barrier state" command that is sent from a compatible wireless transmitter. The change barrier state command transmitted from a wireless transmitter instructs the barrier operator to open a closed barrier, close an opened barrier, or to stop a moving barrier. The control logic maintained by the barrier operator typically is based on what is referred to in the industry as "four-phase logic." Four-phase logic characterizes the movements made by the access barrier during an open/close cycle by the sequence of "open-stop-close-stop" and so on. This sequence is configured as a loop that returns back to the open state once the second stop state has been completed. Thus, each time the change barrier state command is transmitted by the wireless transmitter and received by the barrier operator, the barrier operator proceeds to the next state in the four-phase logic sequence. By incorporating such logic, however, the system prevents wireless transmitters from commanding the barrier operator to move the access barrier in a specific direction, such as up or down, on demand. Alternatively, in commercial or industrial settings barrier, operators that are controlled by wired transmitters utilize discrete open, close, and stop commands that instruct the barrier operator to take a specific action so as to open, close, or stop the access barrier. That is, a wired transmitter may command that the access barrier move in a specific direction on demand.

Wired transmitters used to operate the barrier operator are typically integrated into the logic circuitry of the barrier operator so as to form an operational transmitter/barrier operator pair, such that the wired transmitter is only capable of controlling a single barrier operator to which it is wired. Currently however, it is a common for residential homes to provide garages that utilize multiple garage doors. In order to actuate multiple access barriers, such as garage doors, multiple wired transmitters, each associated with an individual barrier operator, are required to control the movement of the access barriers individually. For example, in the case of a multiple garage door installation, each garage door to be opened, closed, or stopped must be specifically associated with a designated wired transmitter. Thus, the user is required to individually actuate each wired transmitter in order to open, close, or stop all of the doors. Such an arrangement requires each of the wired transmitters to be individually wired with the associated access barrier. Such an arrangement is inconvenient to the user, in as much as he or she is required to physically actuate a dedicated button on each wired transmitter in order to actuate each access barrier, which in some installations may be separated by significant distances from each other. Furthermore, in areas where the weather is often inclement, it is inconvenient for a user to physically go outside, and actuate each wired transmitter especially in the case where the garage is detached from the home and separated by a significant distance.

Therefore, there is a need for a multiple barrier control system that enables one or more local wireless transmitters to simultaneously invoke a function maintained by a plurality of barrier operators. Further, there is a need for a multiple barrier control system that enables one or more local wireless transmitters to simultaneously open, close, and stop a plurality of barrier operators. Additionally, there is a need for a multiple barrier control system that enables various network devices associated with a communication network to simultaneously invoke a function maintained by a plurality of barrier operators. Moreover, there is a need for a multiple barrier control system that utilizes a barrier operator that utilizes a multiple frequency transceiver to facilitate communication between a plurality of barrier operators, various local transmitters, and various network devices associated with the communication network. And there is a need for a multiple barrier operator control system that provides a network bridge device that enables the communication network to communicate with a plurality of barrier operators. There is also a need for a multiple barrier control system that provides a portable network control or computer that provides a graphical user interface (GUI) to display the operational status of each of the plurality of access barriers. And, there is a need for a multiple barrier control system that displays a graphical user interface (GUI) that provides a user with the option of opening all of the access barriers, closing all of the access barriers, or stopping the movement of all of the access barriers simultaneously. Furthermore, there is a need for a multiple barrier control system that provides one or more scene functions that may be invoked by various local transmitters and various network devices so as to control the operation of multiple appliances associated with a communication network with a single button.

SUMMARY OF THE INVENTION

In light of the foregoing, it is a first aspect of the present invention to provide a multiple barrier control system.

It is another aspect of the present invention to provide a multiple barrier control system to simultaneously control the movement of a plurality of access barriers, the system comprising a plurality of barrier operators, each of which are configured to be operatively associated with a corresponding access barrier, the barrier operators each having at least one function in which to control the movement of the corresponding access barrier, and a transmitter adapted to be learned with the plurality of barrier operators, the transmitter having at least one command button, wherein after the transmitter is learned with each of the plurality of barrier operators, the command button is enabled to simultaneously invoke the at least one function at each of the plurality of barrier operators.

Yet another aspect of the present invention is to provide a method of simultaneously controlling a plurality of barrier operators to actuate a plurality of access barriers comprising providing a local transmitter maintaining at least one user invoked function button, learning the local transmitter to a plurality of barrier operators, associating the button with a function maintained by each learned barrier operator, actuating the function button at the local transmitter and simultaneously carrying out the function at each barrier operator learned with the transmitter at the learning step.

Still another aspect of the present invention is to provide a multiple barrier control system to control the movement of a plurality of access barriers, the system comprising a plurality of barrier operators, each of which are configured to be operatively associated with a corresponding access barrier, a multiple frequency transceiver operatively associated with each barrier operator, each transceiver configured to communicate via local signals, and a local transmitter configured to transmit said local signals receivable by the transceiver so as to simultaneously invoke a function maintained by each barrier operator.

BRIEF DESCRIPTION OF THE DRAWINGS

These and other features and advantages of the present invention will become better understood with regard to the following description, appended claims, and accompanying drawings wherein:

BEST MODE FOR CARRYING OUT THE INVENTION

Figure 1:
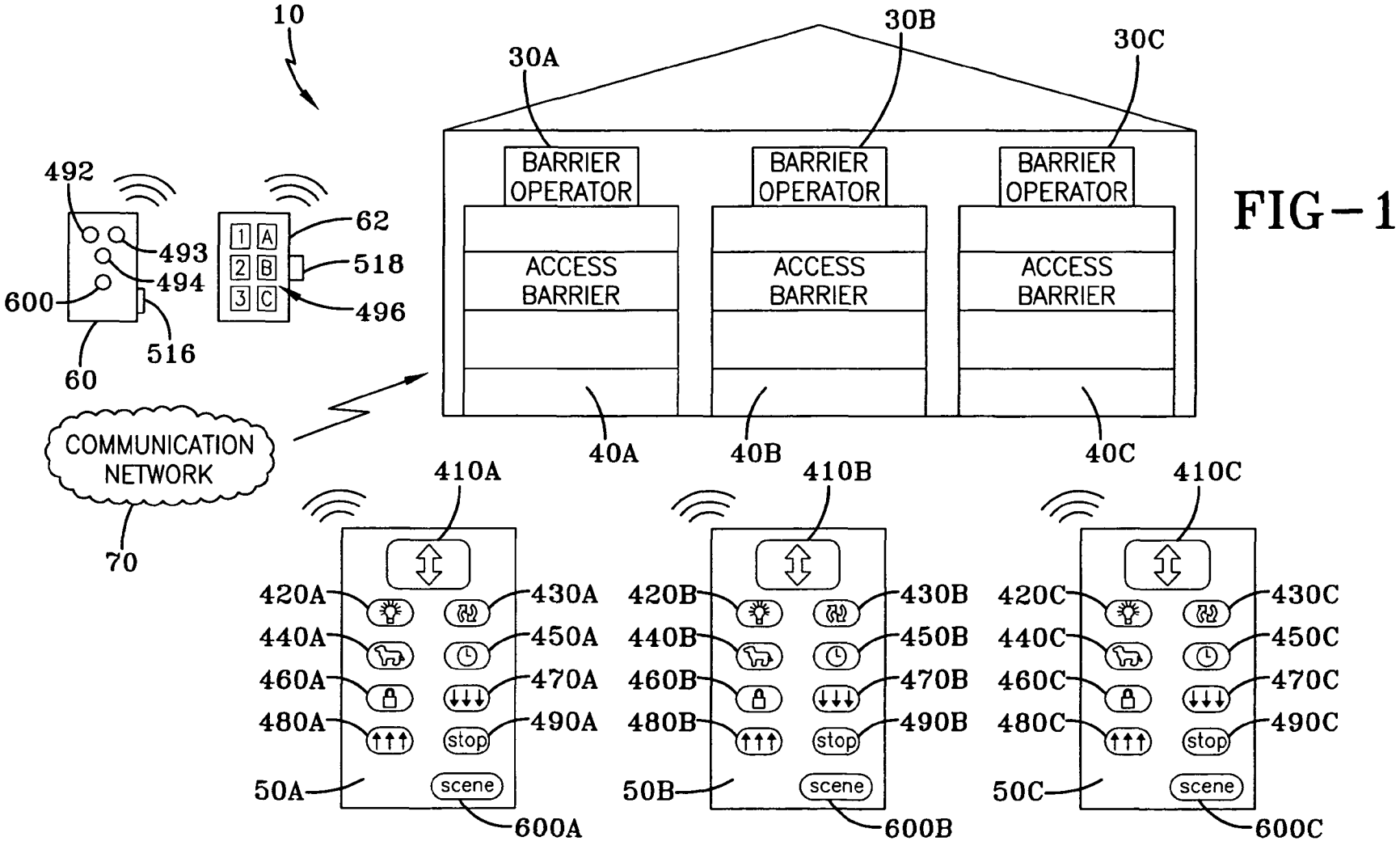
FIG. 1 is a schematic diagram of a multiple barrier control system depicting a building, such as a garage, having multiple barrier operators and associated access barriers configured to be simultaneously controlled by one or more wireless transmitters according to the concepts of the present invention.

A multiple barrier control system is generally referred to by the numeral 10, as shown in FIG. 1 of the drawings. The multiple barrier control system 10 may comprise a plurality of barrier operators 30A-C that are configured to move respective access barriers 40A-C between open and closed limit positions in response to commands sent via local signals transmitted from one or more local wireless wall station transmitters 50A-C, a local remote transmitter 60, or a local keypad transmitter 62. It should be appreciated that the identifiers A, B, and C used throughout the discussion that follows denotes associated groups of transmitters, operators, and an access barrier. For example, access barrier 40A is coupled to barrier operator 30A which is controlled directly by wall station transmitter 50A. Continuing, in order to simultaneously actuate the upward or downward movement of each of the access barriers 40A-C, by one or more of the "local" transmitters 50A-C,60 and 62, each of the local transmitters are individually learned with every barrier operator 30A-C that are associated with the system 10. Once learned, any given local transmitter 50A-C,60 or 62 may individually send commands so as to invoke one or more functions to be simultaneously carried out at each of the barrier operators 30A-C. For example, by depressing a button maintained by the wall station transmitter 50A, a user may invoke the simultaneous opening or closing of all of the access barriers 40A-C. In addition to the commands via local signals transmitted by the wall station transmitters 50A-C, the local remote transmitter 60, or the local keypad transmitter 62, commands may also be sent to the barrier operators 30A-C via network signals originating from various network devices associated with a communication network 70.

The system 10 contemplates the control of multiple access barriers 40A-C, and associated barrier operators 30A-C, however for the sake of clarity, the following discussion will be directed only to the local wall station transmitter 50A, access barrier 40A, and the barrier operator 30A as such discussion applies to all of the wall station transmitters 50A-C, access barriers 40A-C and barrier operators 30A-C. Before setting forth the technical and operational details of the system 10, it is believed that a brief review of the mechanical interrelationship between the barrier operator 30A and the access barrier 40A will facilitate the understanding thereof. As such, with reference to FIG. 2, the opening in which the access barrier 40A is positioned for opening and closing movements relative thereto is defined by a frame 100, which comprises a pair of spaced jambs 102,104 which are generally parallel and extend vertically upwardly from the floor (not shown). The jambs 102,104 are spaced apart and joined at their vertical upper extremity by a header 106 to thereby delineate a generally inverted u-shaped frame around the opening of the access barrier 40A. The jambs 102,104 and header 106 are normally constructed of lumber, as is well known to persons skilled in the art, for purposes of reinforcement and facilitation the attachment of elements supporting and controlling the access barrier 40A, including the barrier operator 30A.

Flag angles 108 are mounted to the jambs 102,104 near the header 106. Connected to and extending from flag angles 108, are respective tracks T, which are located on either side of the access barrier 40A. The tracks T define the travel of the access barrier 40A when moving upwardly from the closed to the open position, and downwardly from the open to the closed position.

Figure 2:
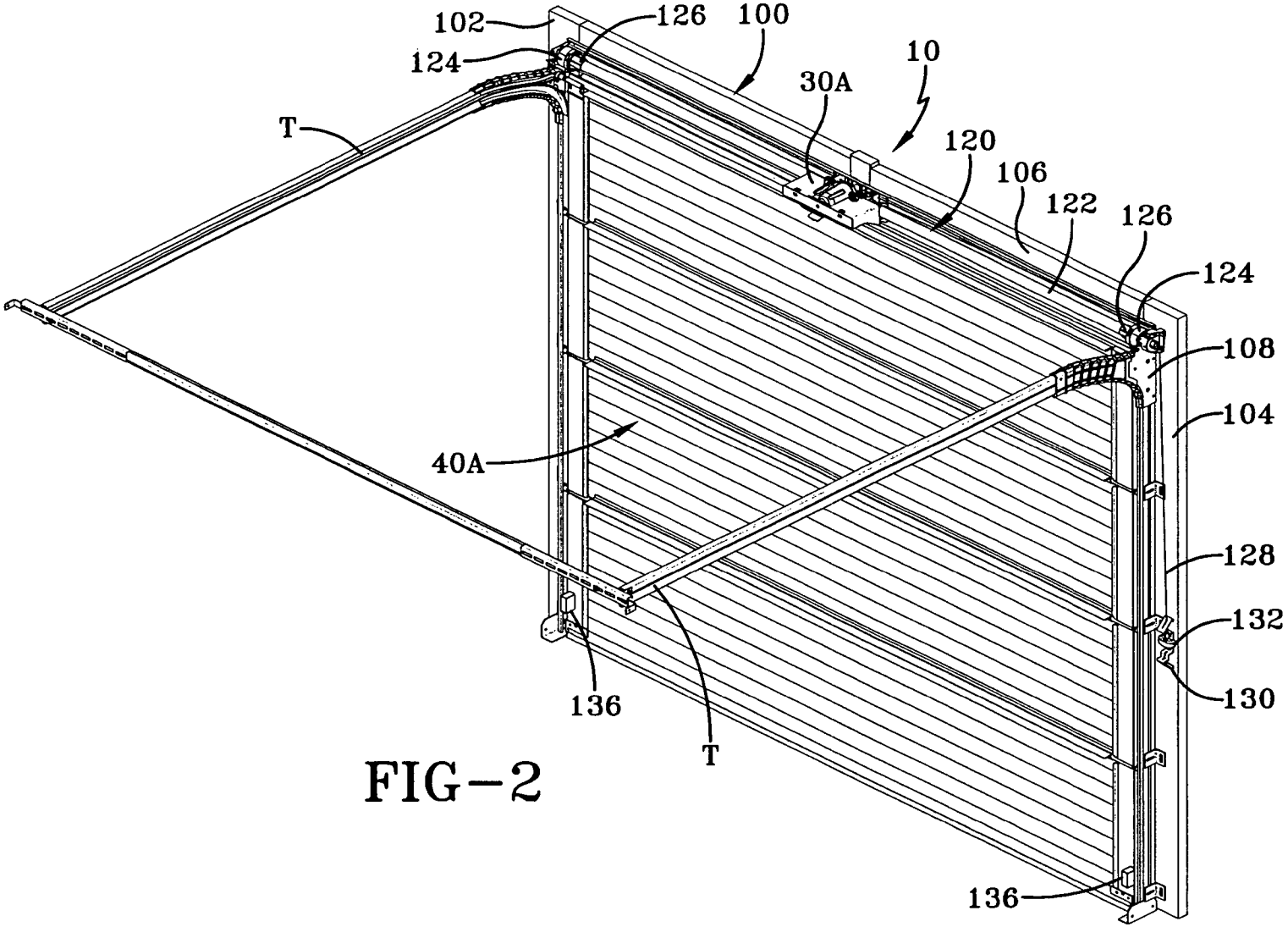
FIG. 2 is a perspective view of an exemplary barrier operator and associated access barrier that is controlled thereby in accordance with the concepts of the present invention.

Continuing with FIG. 2, the barrier operator 30A mechanically interrelates with the access barrier 40A through a counterbalance system generally referred to by the numeral 120. The counterbalance system 120, depicted herein is advantageously in accordance with pending U.S. patent application Ser. No. 11/165,138, which is incorporated herein by reference. Of course, other types of counter-balance systems could be used along with different types of door moving mechanisms. Moreover, the present system is usable with any type of access barrier such as gates, curtains, windows, awnings and any combination thereof. In any event, the counterbalance system 120 includes an elongated non-circular drive tube 122 that extends between tensioning assemblies 124 positioned proximate each of the flag angles 108. Cable drum mechanisms 126 are positioned on the drive tube 122 proximate ends thereof, which rotate with the drive tube 122. The cable drum mechanisms 126 have a cable received thereabout, which is affixed to the access barrier 40A preferably proximate the bottom, such that rotation of the cable drum mechanisms 126 operate to open or close the door 40A in conventional fashion. A disconnect cable 128 is mounted to either one of the jambs 102,104. In particular, the disconnect cable 128 has one end associated or coupled to the operator system and an opposite end terminated by a cable handle 130. A handle holder 132 is secured to either of the jambs 102,104 to hold the cable handle 130. The handle holder 132 provides at least two different positions for the cable handle so as to allow for actuation of the disconnect cable 128. The movement of the disconnect cable 128 connects and disconnects the barrier operator 30A to the counterbalance system 120 as needed.

The barrier operator 30A is mounted to the header 106, and is provided to move the access barrier 40A via the counterbalance system 120 between open and closed positions. If desired, an obstacle detecting photo beam system 136 may be positioned about the opening to which access is controlled by the access barrier 40A. Thus, in the event the photo beam system 136 detects an obstacle in the path and during the access barrier's movement, the barrier operator 30A receives an appropriate signal from the system 136 and may take alternative action, such as reversing the movement of the access barrier 40A away from the identified obstruction.

Figure 3:
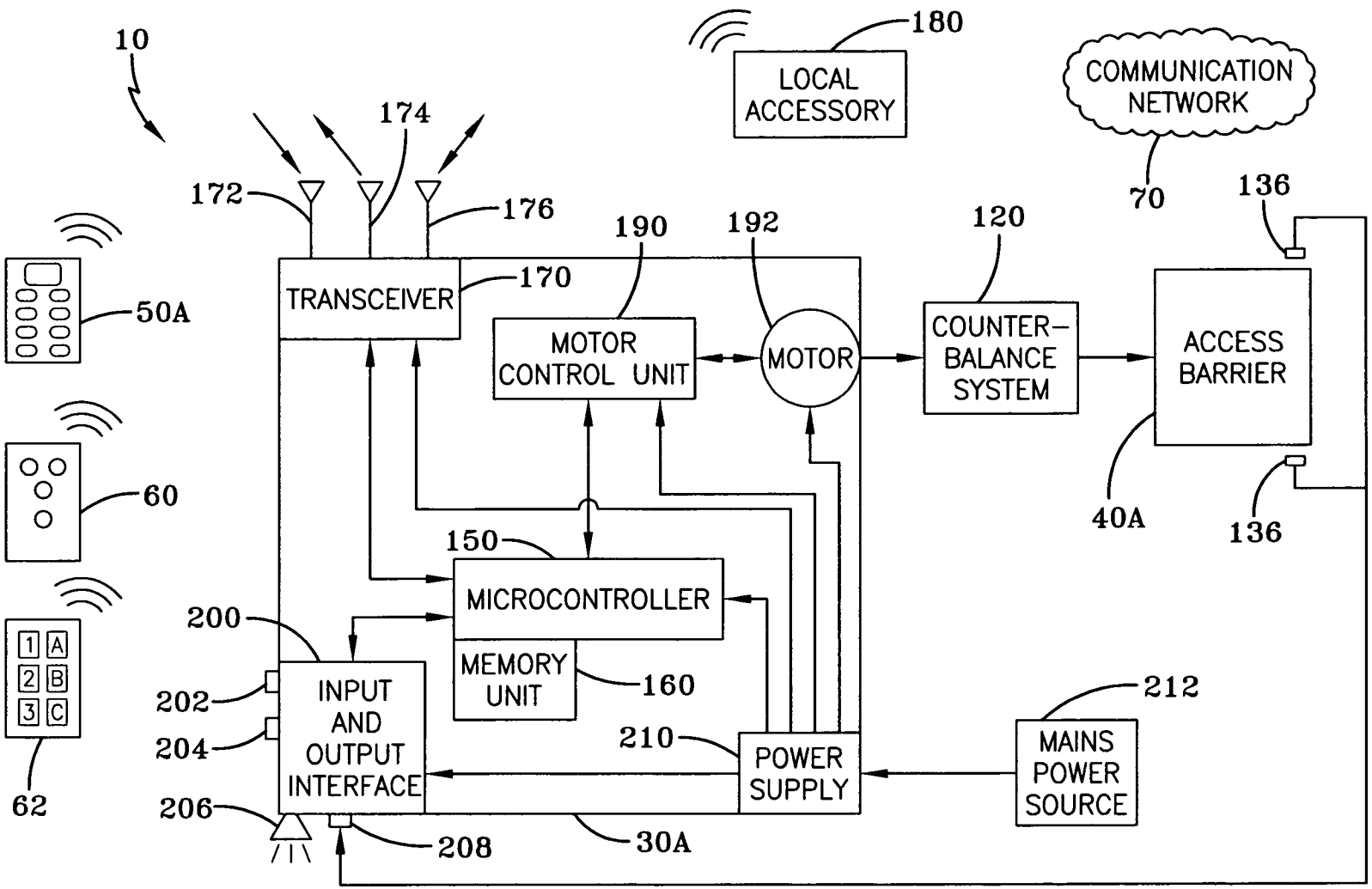
FIG. 3 is a block diagram of the multiple barrier control system showing the interaction between a single barrier operator, various local transmitters and a communication network in accordance with the concepts of the present invention.

Referring now to FIG. 3, the barrier operator 30A controls movement of the access barrier 40A between opened and closed limit positions, and comprises a microcontroller 150 coupled to a memory unit 160. The microcontroller 150 is configured with the necessary hardware, software, and memory to carry out the functions to be described below. In addition, the microcontroller 150 may be comprised of any general purpose or application specific integrated circuit (ASIC) configured to carryout the functions provided by the multiple barrier control system 10. The memory unit 160 may comprise any form of non-volatile memory, including but not limited to electronically erasable programmable read-only memory (EEPROM), flash memory, antifuse memory, or the like. Moreover, the memory unit 160 could be configured as a stand-alone memory, as shown or as an embedded memory that is incorporated into the circuitry of the microcontroller 150. In order to communicate with the local wall station transmitter 50A, the local remote transmitter 60, the local keypad transmitter 62, as well as with the various network devices associated with the communication network 70, a multiple frequency transceiver 170 is coupled to the microcontroller 150.

The multiple frequency transceiver 170 maintains the necessary hardware, software and memory necessary to carry out the various functions to be discussed. Moreover, it is contemplated that the transceiver 170 may be removably interfaced with the barrier operator 30A, or may be integrated into the circuitry comprising the control logic of the barrier operator 30A. To reduce costs, the manufacturer may choose to not include the features of the multiple frequency transceiver into the barrier operator 30A. However, in such a case, a local antenna and receiver (not shown) would be provided by the control logic circuitry maintained by the barrier operator 30A as a standard feature. Thus, in such a circumstance where only the standard receiver is provided, the barrier operator 30A would only be able to receive local signals sent from the various local transmitters 50A-C, 60, and 62, so as to control functions maintained by the barrier operator 30A, and as such would not be able to communicate with the network 70 in any manner. The multiple frequency transceiver 170 operates and maintains a local antenna 172, an accessory antenna 174, and a network antenna 176 to enable receipt of signals with different frequency values. Specifically, the local antenna 172 may be configured to primarily receive commands via local signals transmitted from the local wall station transmitter 50A, the local remote transmitter 60, and the local keypad transmitter 62. In one aspect, the local antenna 172 may be configured to receive a local signal having a carrier frequency of about 372 MHz, for example. The accessory antenna 174 is configured to primarily transmit commands via an accessory signal to a local accessory 180, such as a remotely located and controlled light fixture for example. In one aspect, the accessory antenna 174 may be configured to transmit an accessory signal having a carrier frequency of about 433 MHz, for example. Finally, the network antenna 176 may be configured to transmit and receive various commands, status data, and other information via network signals that may be transmitted to or received from the communication network 70. For example, the network antenna 176 may be configured to receive and transmit network signals having a carrier frequency of about 908 MHz.

The barrier operator 30A also provides a motor control unit 190 that is coupled between the microcontroller 150 and a motor 192. Particularly, the motor control unit 190 processes the control signals delivered by the microcontroller 150 into a compatible format for controlling the motor 192 so as to move the access barrier 40A via the counterbalance system 120 between opened and closed positions. The motor 192 may comprise a DC (direct current) motor suitable for driving the counterbalance system 120, although the barrier operator 30A could be easily configured to control an AC (alternating current) motor if desired. Also coupled to the microcontroller 150 is an input/output (I/O) interface 200 that is configured to allow the user of the system 10 to interact with various functions maintained by the barrier operator 30A. Specifically, the I/O interface 200 provides a door command button 202, a learn button 204, an A/V (audio/visual) indicator 206, and a photo beam input 208. The door command button 202 allows the user to directly close the access barrier 40A coupled to the barrier operator 30A. Whereas the learn button 204 may be actuated by the user so as to allow the barrier operator 30A to be learned with one or more local transmitters 50A,60,62 or local accessories 180. In addition, the learn button 204 may also be used to learn the barrier operator 30A with various network devices that are associated with the communication network 70, which will be discussed in detail later. The A/V indicator 206 may generate an audible and/or visual indication, to identify the status of the access barrier 40A. For example, the A/V indicator 206 may indicate whether the access barrier 40A is fully opened, fully closed, or has been stopped. The A/V indicator 206 may also indicate the presence of a mechanical or electrical fault detected by a diagnostic routine processed by the microcontroller 150. The photo beam input 208 allows the photo beam system 136 to be removably attached or added-on to the barrier operator 30A as desired. A power supply 210 is provided by the barrier operator 30A, which receives standard commercial power, such as 120VAC, from a mains power supply 212. The power supply 210 is coupled to the microcontroller 150, the transceiver 170, the motor control unit 190, the motor 192, and the input/output interface 200 so as to deliver power thereto. In one aspect, the power supply 210 is configured to convert the standard commercial power, or mains power, supplied by the mains power supply 212, into suitable DC power that can be utilized to power the components of the barrier operator 30A discussed above.

Figure 4A:
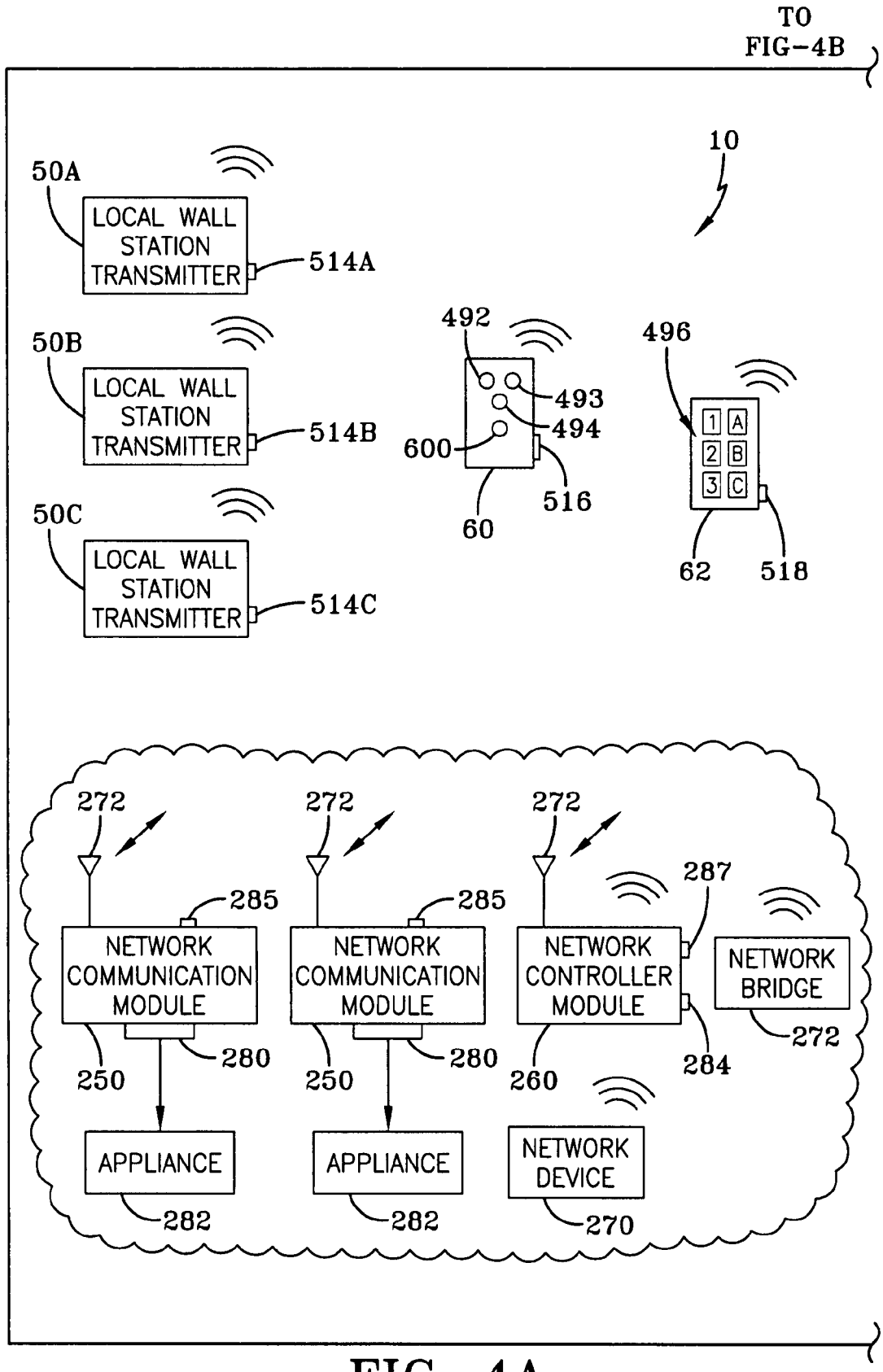
FIG. 4 is a block diagram of the multiple barrier control system showing multiple barrier operators controlled by a command sent from at least one wall station transmitter, a local remote transmitter, a local keypad transmitter, or the communication network in accordance with the concepts of the present invention.
Figure 4B:
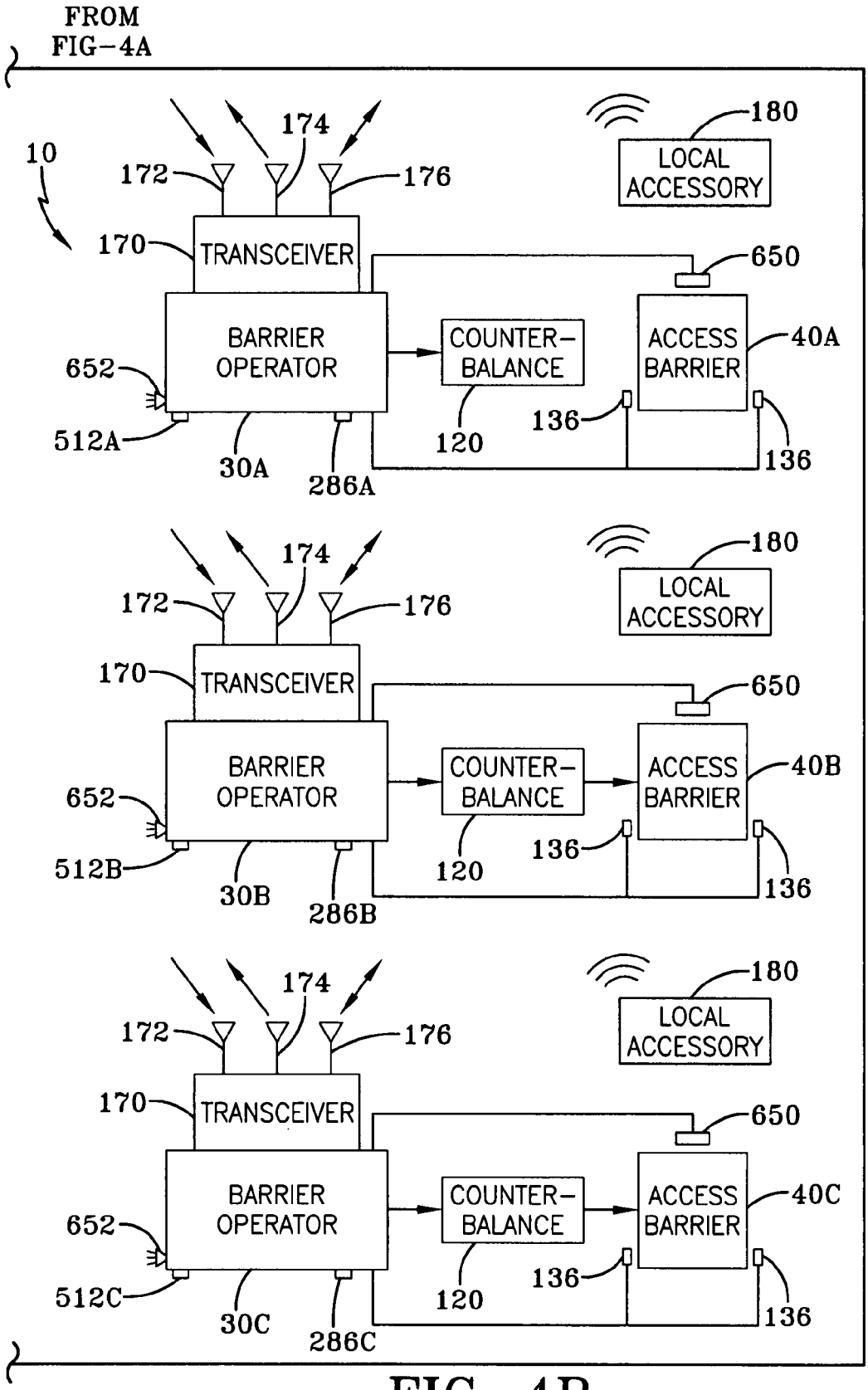

The communication network 70 provided by the system 10, shown in FIG. 4, may comprise various network communication modules 250, at least one network controller module 260, any number of network devices 270, and an optional network bridge 272. The network communication modules 250 and controller module 260 each include an antenna 272, a transceiver (not shown), and the necessary hardware, software, and memory to carry out the functions to be described. The communication module 250 also includes a power control interface 280 that is configured to be coupled to the power input of various network appliances 282 for which remote control via the communication network 70 is desired. For example, the power interface 280 may comprise a standard electrical receptacle that is configured to receive a compatible electrical plug maintained by the appliances 282. The network appliance 282 may comprise any desired device, such as a light, HVAC unit, television, coffee maker, radio thermostat, or any other appliance in which the user desires remote control thereof. In addition, the controller module 260 may be powered by a portable power source, such as a battery, while the communication module 250 may be powered by a mains power source that provides 120 VAC for example. However, it should be appreciated that the communication modules 250 and the controller module 260 may be easily adapted to be operable using an AC or DC power source.

The communication modules 250 each form individual communication nodes that conform to a mesh network communication topology, which utilizes a proprietary or open source communication signal and data protocol. For example, the network controller module 260 and the communication modules 250 may utilize a mesh network that is provided under the trademarks Z-Wave®, Zigbee®, or Bluetooth®. Moreover, the signal protocol utilized by the mesh network 70 establishes that the network controller module 260 is configured as a master, while each of the network communication modules 250 serves as a slave. During operation, the communication modules 250 receive various incoming network signals sent from the network antenna 176 of the multiple frequency transceiver 170 of the barrier operator 30A. And, conversely, the communication modules 250 are also enabled to transmit various outgoing network communication signals for receipt by the network antenna 176 of the barrier operators 30A. Inherent to the mesh network 70, is its ability to dynamically forward any outgoing network signals or any incoming network signals between each node on the basis of a routing table that identifies the relative position of each of the functioning nodes within the communication network 70. If one of the nodes of the communication network 70 becomes disabled, the other nodes, by utilizing the routing table, may re-route the incoming or outgoing network signal around the disabled node so that the network signal reaches its intended destination node. Moreover, the nodes or communication modules 250 that do not originate an outgoing network signal or are not the intended recipient of a network communication signal, serve as repeater nodes that forward the received network signal to the next node 250 based upon the routing table. Thus, once an incoming network signal reaches its intended node within the communication network 70, the command or function code contained therein is processed and carried out by the associated network appliance 282. Alternatively, in the case of an outgoing network signal generated by a given communication module 250, the network signal is routed to the node 250 that is best able to transmit the signal to the network antenna 176 of the barrier operator 30A.

In order to create functional nodes within the communication network 70, the controller module 260 is enabled and learned with each of the network communication modules 250. The learning of each of the communication modules 250 that comprise the network 70 with the controller module 260, allows the controller module 260 to generate the routing table that identifies the particular location of each individual communication modules 250 with respect to other communication modules 250 within the network 70. To allow the controller module 260 to be learned with the various communication modules 250, the communication modules 250 are coupled via their power interface 280 to the power input, such as an electrical plug, of a given appliance 282 of which control is desired. It should be appreciated that the appliances 282 may include, for example, a light, a television, HVAC units, a radio, a coffee maker, thermostat, or any other appliance in which the user desires remote control thereof. Once the communication modules 250 have been associated with the various appliances 282, and arranged in the desired manner throughout a given area, such as a house, to establish the topology of the communication network 70, a learning process is invoked. The learning process may comprise the steps of depressing a learn button 284 on the network controller module 260 and a learn button 285 on each of the network communication modules 250. After each of the communication modules 250 are learned with the network controller module 260, the routing table is formed and it is subsequently stored at the network controller module 260. Again, it should be appreciated that the routing table establishes the most efficient and reliable communication links or paths for which to send various network communication signals between each of the nodes 250 of the communication network 70. Thus, when the mesh network 70 is implemented within the context of a home, for example, the routing table identifies the various communication nodes created based on the relative location of the appliances 282 to be controlled.

Once the communication modules 250 and the controller module 260 have been learned to each other, the routing table maintained by the network controller module 280 is replicated, or otherwise copied, to the memory unit 160 maintained by the barrier operator 30A. This may be accomplished by depressing a replicate button 286A maintained by the barrier operator 30A, and a replicate button 287 maintained by the network controller module 260. Once the routing table defining the nodes of the communication network 252 is stored at the barrier operator 30A, the local transmitters 50A-C,60,62 may control the operation of the various network appliances 282 maintained by the communication network 70. In other words, the local wall station transmitter 50A, the local remote transmitter 60, and the local keypad transmitter 62 are enabled to selectively transmit various commands via local communication signals to the barrier operator 30A, which are then translated and processed by the microcontroller 150 to control functions at the barrier operator 30A, functions maintained by the local accessory 180, or functions maintained by the network appliance 282.

Various network devices 270, which will be discussed in detail, may communicate commands via network signals to each of the barrier operators 30A-C so as to simultaneously control the movement of each of the associated access barriers 40A-C in a manner to be discussed. As such it is this simultaneous control of a plurality of access barriers 40A-C from a local transmitter 50A-C,60,62 or network device, which forms the basis of the multiple barrier control system 10, and the detailed discussion that follows. The various network devices 270 maintained by the communication network 70 enable users to invoke various functions at the network 70, at each of the barrier operators 30A-C, and at various local accessories 180.

Figure 5:
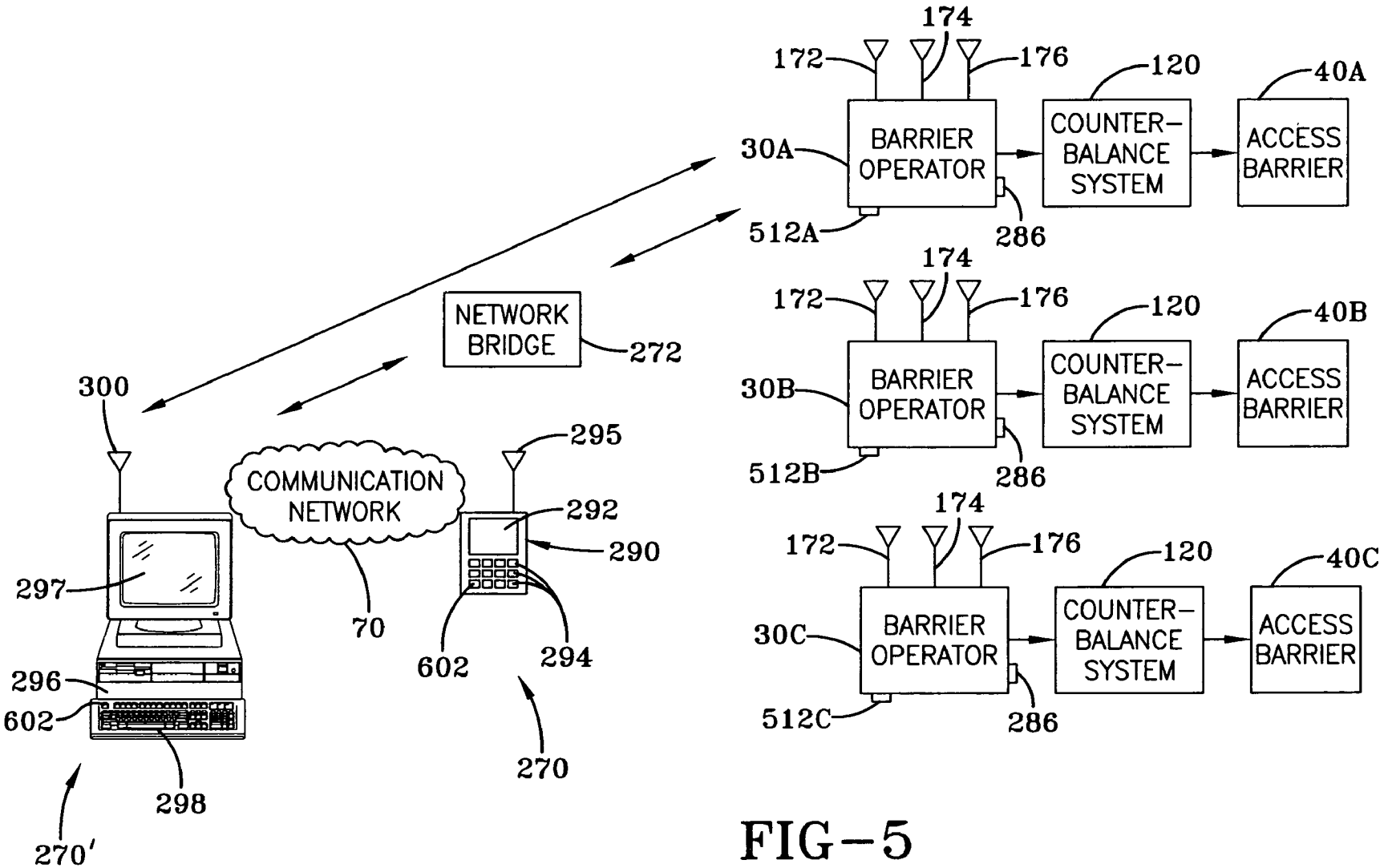
FIG. 5 is a schematic diagram of the multiple barrier control system showing the interaction of a portable network control with multiple barrier operators in accordance with the concepts of the present invention.

One type of network device is a portable network control 290 shown in FIG. 5, which includes the necessary hardware, software, and memory necessary to carry out the functions to be discussed. In addition, the portable network control 290, includes a display 292, and one or more selection buttons 294.

The display 292 may comprise a liquid crystal display (LCD) or any other type of viewable display suitable for a portable device. The portable network control 290 also includes an antenna 295 and a transceiver (not shown) capable of receiving and transmitting network signals so as to communicate with the network 70. Although, the network control 290 provides various selection buttons 294 to invoke various functions to be discussed, it should also be appreciated that the portable network control 290 may comprise a touch sensitive display, which is responsive to an external input device, such as a stylus or mouse. In one aspect, the portable network control 290 may comprise a personal digital assistant (PDA), laptop computer, or any other mobile computing device that is configured with suitable software to carry out the functions to be described.

Aside from the portable network control 290, the network device 270 may also comprise a personal computer 296, which provides a viewable display terminal 297, and an input device 298. The personal computer 296 also includes an antenna 300, and a transceiver (not shown) capable of receiving and transmitting network signals so as communicate with the network 70. Moreover, the personal computer 296 maintains the necessary hardware, software, and memory needed to carryout the functions to be described. In one aspect, the display terminal 297 may comprise a cathode ray tube (CRT) or liquid crystal type display, or other type of suitable display, whereas the input device 298 may comprise a keyboard or other type of data input system, such as a mouse.

When the network devices 270, including the portable network control 290 or personal computer 296 are activated, the barrier operators 30A-C may send status data identifying the particular state that each of the access barriers 40A-C are in, as well as other data. It should be appreciated that the network devices 270 may transmit a request for such information to each of the barrier operators 30A-C, or the barrier operators 30A-C may periodically transmit or "push" data associated with the position or "state" of the access barriers 40A-C to the network devices 270 for display thereby. In addition, status information may include various data relating to the operation of the barrier operator 30A-C, as well as data relating to the position of each of the access barriers 40A-C along its path of travel. For example, status data may indicate whether the access barrier 40A is opened or closed for example. Status data received by the network devices 270 is then presented on the displays 292,297 of the portable network control 290 or personal computer 296 via a graphical user interface (GUI) 310. The GUI 310, shown in FIG. 6, visually indicates the particular position of each of the access barriers 30A-C, such as whether it is opened or closed, and provides other operational data for review by the user, which will be discussed further below.

Figure 6:
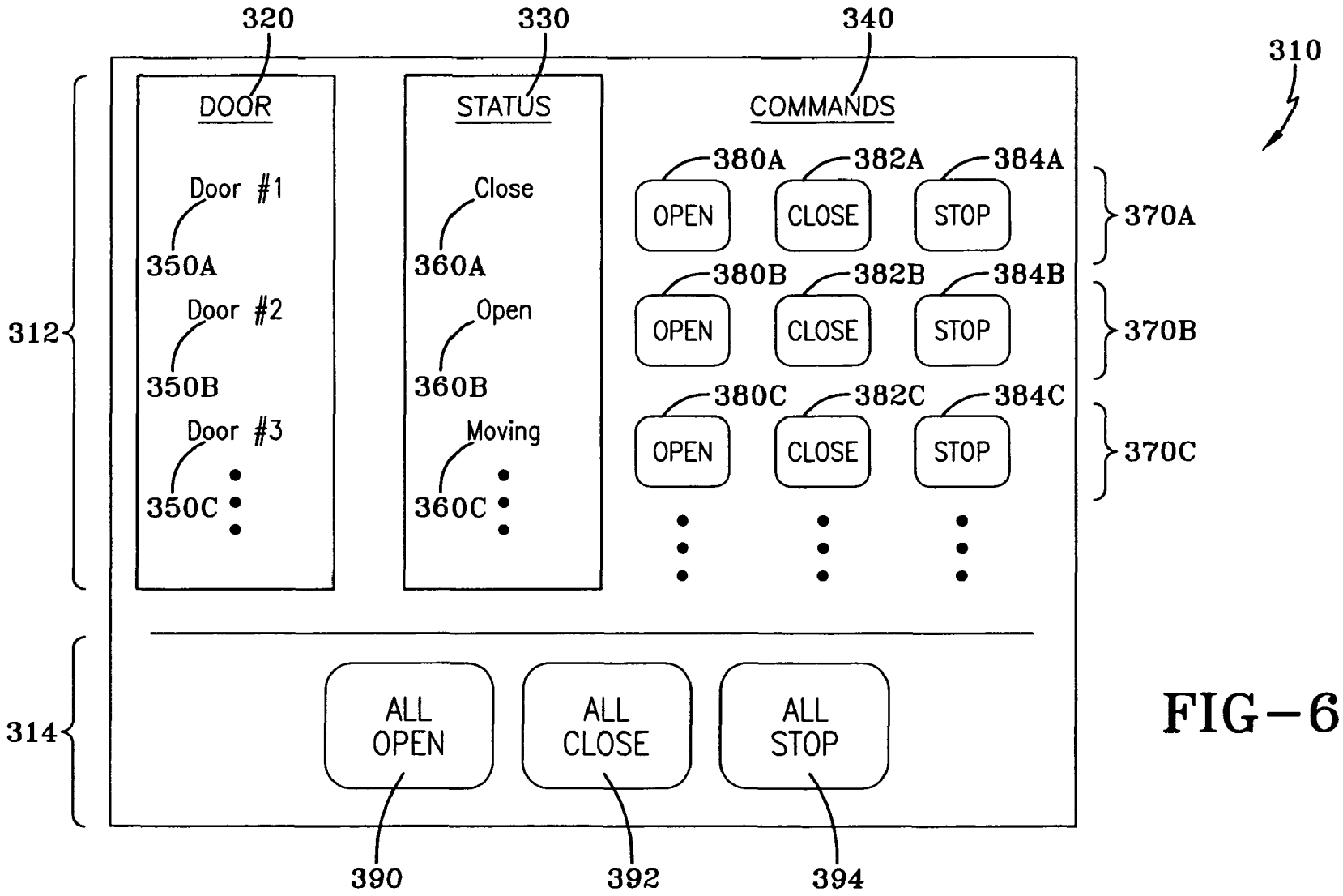
FIG. 6 is a plan view of the multiple barrier control system showing a graphical user interface (GUI) configured to allow a user to simultaneously or individually control multiple barrier operators via the communication network in accordance with the concepts of the present invention.

Continuing with FIG. 6, the graphical user interface (GUI) 310 is separated into two regions, a status/command region 312, and a simultaneous control region 314. The status/command region 312 comprises a plurality of data fields that include a door field 320, a status field 330, and a commands field 340. The door field 320 provides various alphanumeric operator tags that identifies each of the particular barrier operators 30A-C that currently comprise the system 10. For example, an operator tag 350A may denote "Door 1" to identify the access barrier 40A, an operator tag 350B may denote "Door 2" to identify the access barrier 40B, and an operator tag 350C may denote "Door 3" to identify the access barrier 40C.

The status field 330 provides various status tags that indicate the operational status associated with each corresponding operator tag 350A-C. The status tags may take on the values of: opened, closed, moving, stopped not at limit, and no report. For example, as shown in FIG. 6, a status tag 360A associated with the access barrier 40A indicates that it is closed, whereas a status tag 360B associated with the access barrier 40B indicates that it is open. Finally, a status tag 360C associated with the access barrier 40C indicates that it is in the process of "moving" between its limit positions.

The commands field 340 comprises multiple sets of command options 370A, 370B, and 370C associated with each individual barrier operator 30A-C as identified by the barrier tags 350A, 350B, and 350C. Each set of command options 370A-C comprises an open option 380A-C, a close option 382A-C, and a stop option 384A-C. As such, command option set 370A is associated with controlling the access barrier 40A, command option set 370B is associated with controlling the access barrier 40B, and command option set 370C is associated with controlling the access barrier 40C. For example, the open option 380A, when selected, results in the network device 270, such as the portable network control 290 or the personal computer 296, transmitting associated commands via a network signal to the barrier operator 30A, with which the open option 380A is associated, so as to open the access barrier 40A accordingly. The close option 382A, when selected, results in the network device 270 transmitting a close command via a network signal to the barrier operator 30A with which the close option 382A is associated, so as to close the access barrier 40A. The stop option 384A, when depressed, results in the network device 270 transmitting a stop command via a network signal to the barrier operator 30A, with which the close button 384A is associated, so as to stop the access barrier 40A. While the GUI 310 has been discussed as being configured to control 3 barrier operators 30A-C, it should be appreciated that the GUI 310 may be configured to control any number of barrier operators. Although only the actuation of the options associated with the access barrier 40A have been discussed, it should be apparent that by actuating the open, close, and stop options 380B-C, 382B-C, and 384B-C in a manner that equivalent to that discussed with regard to access barrier 40A that control of the access barriers 40B and 40C may be obtained.

The simultaneous control region 314 of the GUI 310 comprises simultaneous control options, which include an all open option 390, an all close option 392, and an all stop option 394. The all open option 390, when selected, causes the network device 270 to transmit an all open command via a network signal to each of the barrier operators 30A-C which are part of the system 10, so as to initiate the simultaneous opening of all of the access barriers 40A-C. Next, the all close button 392, when selected, causes the network device 270 to transmit a command via a network signal to each of the barrier operators 30A-C which are part of the system 10, so as to initiate the simultaneous closing of each of the access barriers 40A-C associated therewith. Finally, the all stop option 394, when selected, causes the selected network device 270 to transmit an all stop command via a network signal to each of the barrier operators 30A-C which are part of the system 10, so as to initiate the simultaneous stopping of all of the access barriers 40A-C.

While the prior discussion relates to the use of the barrier operator 30A with the multiple frequency transceiver 170 it is also contemplated that the transceiver 170 may be removably interfaced with the barrier operator 30A, allowing the user to upgrade a compatible barrier operator at a later date. Additionally, it is also contemplated that legacy barrier operators, or those that are not configured to be interfaced with the multiple frequency transceiver, may be enabled to communicate with the communication network 70. Thus, in order to enable current barrier operators that have not been upgraded, or otherwise interfaced with the multiple frequency transceiver 170, or to enable legacy barrier operators each of which only maintain a standard local antenna and receiver, or are otherwise unable to communicate with the communication network 70, the network bridge device 272 may be utilized.

The network bridge device 272 comprises the necessary hardware, software, and memory to translate network signals transmitted by the communication network 70 into local signals that can be received by the standard local antenna and receiver (not shown) maintained by the standard or legacy barrier operator previously discussed. Thus, in order to control the barrier operator 30A in accordance with the options provided by the GUI interface 310 using the network devices 270, such as the portable network control 290 or personal computer 296, a command carried by a network signal may be sent from the network devices 270 to the network bridge device 272. The network bridge device 272 then translates the received network signal into a corresponding local signal having the frequency and format that is compatible with the operation of the local barrier antenna and receiver maintained by the barrier operator. The translated local signal carrying the desired command is then forwarded to the barrier operator 30A where the command is then carried out.

While the network devices 270, including the portable network control 290 and the personal computer 296, may be configured to remotely actuate each of the barrier operators 30A-C via the communication network 70, the local transmitters, including the local wall station transmitters 50A-C, the local remote transmitter 60, and the local keypad transmitter 62 also contain the ability to control each of the barrier operators 30A-C so as to simultaneously open, close, or stop each of the access barriers 40A-C. Returning to FIG. 1, the local wall station transmitters 50A-C comprises multiple function buttons, including an up/down button 410A-C, a lamp button 420A-C, an install button 430A-C, a pet open button 440A-C, a delay close button 450A-C, a lock button 460A-C. These buttons are associated with functions maintained by the individual barrier operator 30A-C to which each of the wall station transmitters 50A-C are respectively learned or otherwise associated. In keeping with the nomenclature used above, the buttons designated by the identifiers "A," "B," and "C" are configured to only individually control functions maintained by respective barrier operators 30A, 30B, or 30C. In addition, the wall station transmitters 50A-C each include an all close button 470 A-C, an all open button 480A-C, and an all stop button 490A-C that are configured to actuate each of the barrier operators 30A-C simultaneously with the actuation of a single button. Thus, in other words, the buttons 410A-460A control functions only at the barrier operator 30A, buttons 410B-460B control functions only at the barrier operator 30B, and buttons 410C-460C control functions only at barrier operator 30C. Whereas the "all" command buttons 470A-C, 480A-C, and 490A-C when selected are each enabled control a function simultaneously at each of the barrier operators 30A-C. For example, the button 480B when actuated invokes the opening of access barriers 40A, 40B, and 40C.

Specifically, the up/down button 410A-C when actuated, allows the access barriers 40A-C to be moved between limit positions. Next, the lamp button 420A-C when actuated energizes the local accessory 180, which may comprise a remote light that is in wireless communication with the accessory antenna 174 maintained by the barrier operators 30A-C. The install button 430A-C enables automatic limit and force determination at the barrier operator 30A when moving the access barriers 40A-C between limit positions for when the barrier is initially installed. The pet open button 440A-C allows closed access barriers 40A-C to be opened to predetermined height to allow a pet to have suitable ingress and egress there through. Next, the delay close button 450A-C commands the barrier operators 30A-C to close the access barrier 40A-C after a predetermined time period has expired. For example, the system 10 may be configured so that a predetermined period after the delay close button 450A-C is actuated that the barrier operators 30A-C respectively associated with the particular local wall station transmitter 50A-C closes the access barrier 40A-C. The lock button 460 when actuated, locks the barrier operator 50A, such that it is prevented from carrying out any commands communicated to it via the local wall station transmitters 50A-C, the local remote transmitter 60, and the local keypad transmitter 62. The all close button 470, when actuated, commands each access barrier 40A-C provided by the system to simultaneously close. The all open button 480 when actuated, commands each access barrier 40A-C provided by the system to simultaneously open. Finally, the all stop button 490 when actuated, commands each access barrier 40A-C provided by the system to simultaneously stop.

In addition to the local wall station transmitters 50A-C, the local remote transmitter 60 and the local keypad transmitter 62 may be enabled to communicate with the various access barriers 30A-C so as to invoke the simultaneous control of the access barriers 40A-C. Specifically, as shown in FIGS. 1 and 4, the local remote transmitter 60 may include an all open button 492, an all close button 493, and a stop button 494. As such, the local remote transmitter 60 may invoke the simultaneous opening, closing, and stopping of the access barriers 40A-C via the actuation of the respective all open, all close, and all stop buttons 492,493,494. The local keypad transmitter 62 on the other hand provides an alphanumeric keypad 496 that may be used to allow a user to input a code so as to invoke the simultaneous opening, closing, and stopping of each the access barriers 40A-C. That is, various predetermined codes may be configured to be associated with simultaneously opening all of the access barriers 40A-C, closing all of the access barriers 40A-C, and stopping all of the access barriers 40A-C.

Figure 7:
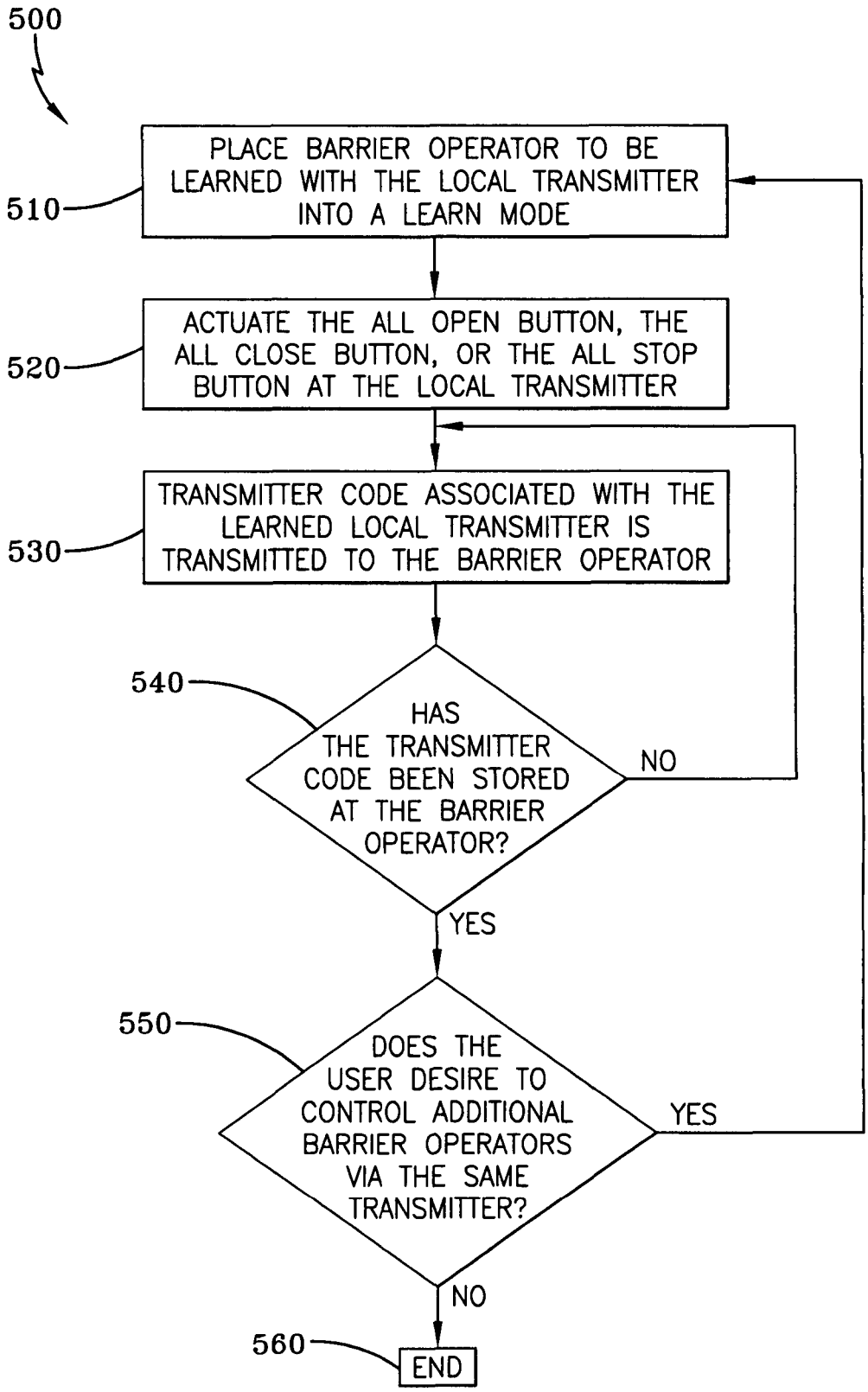
FIG. 7 is a flowchart showing the operational steps taken by the multiple barrier control system when the local transmitters and the portable network control are learned with a plurality of barrier operators in accordance with the concepts of the present invention.

While the discussion above relates to the functional aspects and communication relationships established between the barrier operators 30A-C, the local transmitters 50A-C,60,62, and the various network devices 270 maintained by the communication network 70, it should be appreciated that certain configuration steps are initially required before the aforementioned components comprising the control system 10 are made fully operational so as to enable simultaneous control of each of the access barriers 40A-C. Thus, to enable the local transmitters 50A-C,60,62 and the network devices 270 to simultaneously open, close, and stop the movement of each of the access barriers 40A-C, a learn process is required to be initially invoked. This learn process takes place between a selected local transmitter 50A-C,60,62 or network device 270, and each barrier operator 30A-C of which simultaneous control is desired. Specifically, the operational steps for learning a desired local transmitter 50A-C,60,62 with one or more barrier operators 30A-C are generally referred to by the numeral 500, as shown in FIG. 7. Initially, at step 510 the user places one of the barrier operators 30A-C into a learn mode, as well as one of the local transmitters 50A-C,60,62. In one aspect, the barrier operator 30A-C may be placed into a learn mode by actuating a learn button 512A-C, while the local transmitter 50A-C, 60, 62 may be placed into a learn mode by actuating a learn button 514A-C, 516, and 518 respectively. It is also contemplated that in lieu of learn buttons 514A-C, 516, and 518, that the local transmitters 50A-C, 60, 62 may be placed into a learn mode by the depression of the various other buttons maintained thereby in a predetermined sequence. Once, the selected local transmitter 50A-C,60,62 or network device 70 is placed into a learn mode, the user then actuates one of the all close button 470, the all open button 480, or the all stop button 490, as indicated at step 520. Continuing to step 530, once the command code associated with the selected button 470-490 is received by the barrier operator 30, the transmitter code associated with the button selected at step 520 is stored at the memory unit 160 of the barrier operator 30A-C which is being learned. If the transmitter code has not been stored at the memory unit 160, then the process 500 returns to step 530. However, if the transmitter code has been stored at the barrier operator 30A-C, then the process 500 continues to step 550. At step 550, the process 500 determines whether the user desires to control additional barrier operators using the same local transmitter 50A-C,60, 62 or network device 270 used to learn the barrier operator 30A-C selected at step 510. If the user does desire to associate the selected transmitter with additional barrier operators, then the process 500 returns to step 510 where steps 510-550 are repeated so as to learn the transmitter to another barrier operator. However, if at step 550 the user does not desire to learn the barrier operator with additional barrier operators, the process continues to step 560, where the process 500 terminates.

In another aspect of the system 10, it is contemplated that the network communication modules 250 may be configured to receive a scene command sent in response to the actuation of a local scene control button 600 maintained by one of the various local transmitters 50A-C,60 or via an associated scene code input to the local keypad transmitter 62. Additionally, the network devices 270, including the portable network control 290 or personal computer 296 may also provide a network scene button or option 602 that when actuated invokes the various functions discussed below. Before discussing the manner in which a scene may be invoked it is helpful to understand that a scene is configured by utilizing multiple communication modules 250 and network appliances 282 comprised of lights. And by setting the desired lighting intensity at each communication module 250 associated with each light appliance 282 that is to be part of the scene. For example, the light intensity of each light may take on any level between off and full brightness. Thus, to create a scene, the scene buttons 600,602 may be depressed for a predetermined period of time so that a scene mode is entered. Once the scene mode is entered, the learn button 285 of the communication modules 250 may serve as a dimmer, and may be depressed until the desired light intensity is achieved at each light comprising the scene. In addition to the lighting aspects of the scene, various positions of the access barriers 40A-C may also be associated with a particular scene. Thus, while the system 10 is in the scene mode, each of the access barriers 40A-C may be individually actuated to a desired position which will be attained when the particular scene is invoked. Once the desired position of the barrier is attained, then actuation of a designated button or series of buttons on a transmitter and/or wall station associated with the barrier may be used to confirm or set the barrier's position for a particular scene. As such, when the scene button 600 or 602 is actuated or scene code is input, each of the light based appliances 282 are illuminated in the configured manner, and each of the access barriers 40A-C are automatically moved to the predetermined position, so as to create a "scene." In addition to the interior lights, the scene may be adapted to include a number of door locks, security lights, and home alarm systems that may be associated with the network communication modules 250 comprising the network 70.

In yet another aspect of the present invention 10, it is contemplated that a fume detector 650, such as a carbon monoxide (CO) detector, and an alarm 652 may be operationally associated with each of the barrier operators 30A-C, as shown in FIG. 4. The fume detector 650 may be mounted so as to detect the presence of dangerous fumes within the area whose access is controlled by the access barriers 40A-C. In order to provide additional protection to the structure to which the access barriers 40A-C are apart, the fume detector 650, the alarm 652, and the light appliances 282 may be programmed to be operate together in association with a particular "alarm scene" mode. During the programming of the "alarm scene" mode the various network communication modules 250 and associated light appliances 282 are arranged through out the area in which an alert is desired, such as a home, for example. Next, the intensity of each of the light appliances 282 is adjusted, as previously discussed, to the desired level to be displayed when an alarm condition is encountered. Once the "alarm scene" is programmed, an associated alarm scene mode may be invoked by actuating the scene buttons 600,602 at the various transmitters 50A-C,60, 62 and network devices 270 respectively in the manner previously discussed. Once invoked, the fume detector 650 is made active and proceeds to monitor for the presence of dangerous fumes. In the event that one of the fume detectors 650 detects the presence of harmful gas, such as, carbon monoxide, for example, the particular barrier operator 30A-C associated which has detected the fumes, generates an alarm scene command that is transmitted to the communication network 70 and to the remaining barrier operators 30A-C installed at the site. In response to the alarm scene command, the network light appliances 282 associated with the scene are invoked so as to illuminate in the preconfigured manner associated with the alarm mode, while the alarm 652 sounds, and each of the access barriers 40A-C are moved to a predetermined position, such as a full opened position, so as to provide ventilation for the accumulated fumes.

It is also contemplated that the present invention 10 may include a "lock home scene" and an "arrive home scene," which can be selectively invoked in a manner similar to that of the "alarm scene" discussed above. As such, when a user of the present invention 10 leaves home, he or she may actuate the scene button 600,602 thereby invoking the "lock home scene." Upon the invocation of the "lock home scene" each of the access barriers 40A-40C are placed into their fully closed positions. In addition, the local accessories 180 and the network appliances 282 which comprise lights may be selectively turned on and off in response to the activation of the "lock home scene." Such a feature thus allows a suitable amount of light to be shown so as to give the impression that someone is currently home. Finally, the activation of the "lock home scene" results in the arming of a home alarm. Therefore, the activation of the "lock home scene" automatically controls a variety of components of the present invention 10 so as to enhance the security of a user's home.

Correspondingly, the present invention 10 may also include an "arrival home scene" as well. The "arrival home scene" may be invoked in a manner similar to that of the "lock home scene" discussed above. The "arrival home scene" is generally invoked after the "lock home scene" has been set. Thus, for example, when a user returns home after having set the "lock home scene," he or she may then actuate the "arrival home scene" via the scene button 600 or 602 via the network devices 270, 270' and transmitters 50A-C, 60, and 62. Upon the selection of the "arrival home scene" the access barriers 40A-C are moved from fully closed positions to predetermined opened positions. In addition, the activation of the various lights comprised by the local accessory 180 and/or the network appliances 282 are turned on in a predetermined arrangement to give the user suitable light to navigate the particular portions of the home. Finally, the actuation of the "arrival home scene" disarms the home alarm that was set when the "lock home scene" was invoked, thus allowing the user to enter his or home.

Based upon the foregoing, one advantage of a multiple barrier control system is that one or more local transmitters may be configured to simultaneously actuate a plurality of barrier operators so as to open, close, and stop each of the associated access barriers at once. Another advantage of the multiple barrier control system is that the barrier operator provides a multiple frequency transceiver that is configured to receive commands from both local transmitters and a communication network. Still another advantage of the multiple barrier control system is that the communication network configured to communicate with each barrier operator includes a portable network control. Yet another advantage of the multiple barrier control system is that the portable network control is configured to communicate commands to the barrier operators via the communication network. An additional advantage of the multiple barrier control system is that one or more network appliances may be remotely controlled via various local transmitters. An additional advantage of the multiple barrier control system is that various "scenes" utilizing one or more network appliances can be remotely invoked via a single button maintained by the various local transmitters.

Thus, it can be seen that the objects of the invention have been satisfied by the structure and its method for use presented above. While in accordance with Patent Statutes, only the best mode and preferred embodiment has been presented and described in detail, it is to be understood that the invention is not limited thereto and thereby. Accordingly, for an appreciation of the true scope and breadth of the invention, reference should be made to the following claims.

What is claimed is:

1. A multiple barrier control system to simultaneously control the movement of a plurality of barriers as part of a scene, the system comprising:

a plurality of barrier operators, each of which are configured to be operatively associated with a corresponding barrier, said barrier operators each having at least two functions in which to control the movement of the corresponding barrier;

at least one appliance adapted to be remotely controlled; and a transmitter adapted to be learned with said plurality of barrier operators, said transmitter having at least two command buttons, at least one function button and at least one scene button, wherein after said transmitter is learned with each of said plurality of barrier operators and said appliance, said at least two command buttons are enabled to simultaneously invoke said at least two barrier movement functions at each of said plurality of barrier operators, said at least one function button is enabled to invoke barrier movement functions at a specific one of said plurality of barrier operators and said at least one scene button is enabled to operatively control said at least one appliance to a predetermined condition and invoke predetermined barrier movement functions at all of said plurality of barrier operators to adjust each barrier to a close position, an open position, or a desired position in between the open and close position, wherein said predetermined barrier movement functions move each barrier to a position which is different than the position of the other barriers.

2. The system according to claim 1, wherein said function maintained at said plurality of barrier operators and invoked by said at least two command buttons are at least a stop all function and either an open all function or a close all function.

3. The system according to claim 1, further comprising:

a communication network configured to communicate with each of said plurality of barrier operators and said at least one appliance via network signals, said communication network configured to simultaneously invoke two of said at least two barrier movement functions maintained by each of said plurality of barrier operators and/or control said at least one appliance to said predetermined condition.

4. The system according to claim 3, further comprising;

a portable network control associated with said communication network, wherein said function or control of said at least one appliance is invoked in response to a portable network control command sent by said portable network control.

5. The system according to claim 4, wherein said portable network control includes a graphical user interface (GUI) configured to present a status/command region and a simultaneous control region.

6. The system according to claim 5, wherein said status/command region comprises a barrier field configured to display an operator tag identifying each said barrier operator, a status tag associated with each said operator tag, said status tag indicating the operational status of each said barrier operator, and wherein said status/command region comprises a command option set associated with each said respective barrier operator, each said command option set providing at least two user selectable command options associated with respective functions maintained at each said barrier operator, such that when said command option is invoked said function is carried out at said barrier operator associated with said respective command option.

7. The system according to claim 6, wherein said command option is selected from the group consisting of an open option, a close option, and a stop option.

8. The system according to claim 6, wherein said simultaneous control region comprises three simultaneous control options associated with each said function maintained at each of said plurality of barrier operators, such that when said simultaneous control option is selected, said function is simultaneously performed at each of said barrier operators, wherein said simultaneous control options are selected from the group consisting of an all open option, an all close option, and an all stop option.

9. A method of simultaneously controlling a plurality of barrier operators to actuate a plurality of barriers as part of a scene comprising:

providing a local transmitter maintaining at least one user invoked function button, at least two user invoked command buttons, and at least one scene button, wherein the function button controls movement of a specific barrier, the command buttons control movement of a plurality of barriers including said specific barrier and said at least one scene button controls at least one appliance and selected ones of said plurality of barriers;

learning said local transmitter to a specific barrier operator, a plurality of barrier operators that includes said specific barrier operator, and said at least one appliance;

associating said function and command buttons with a respective movement function maintained by each said learned barrier operator;

associating said at least one scene button with a predetermined condition of said at least one appliance and a predetermined open, close or in between position for selected ones of said plurality of barriers;

actuating one of said command buttons at said local transmitter;

simultaneously carrying out said respective movement function at each barrier operator learned with said transmitter at said learning step wherein said command buttons invoke at least two barrier movement functions at each of said plurality of barrier operators; and actuating said at least one scene button at said local transmitter and invoking said predetermined condition of said appliance and moving selected said barriers to said predetermined positions, wherein each selected said barrier is moved to a predetermined position which is different than a predetermined position of the other selected said barriers.

10. The method of claim 9, further comprising:

communicating with said plurality of barrier operators via a communication network and a network device.

11. The method of claim 10, further comprising:

providing a viewable display on said network device.

12. The method of claim 11, further comprising:

providing a graphical user interface (GUI) on said viewable display to indicate the status of each of the access barriers.

13. The system according to claim 1, further comprising:

a multiple frequency transceiver operatively associated with each said barrier operator, each said transceiver configured to communicate via local signals; and said transmitter configured to transmit said local signals receivable by said transceiver.

14. The system according to claim 13, further comprising:

a communication network associated with said multiple frequency transceiver via network signals, said communication network associated with a network device that is configured to transmit network signals to each said barrier operator so as to simultaneously invoke a function maintained thereby.

15. The system of claim 14, wherein said network device includes a network scene control button that when actuated is configured to simultaneously move each of the access barriers to a predetermined close position, a redetermined open position, or a predetermined position in between the open or close positions.

16. The system of claim 13, wherein said local transmitter includes a local scene control button that when actuated is configured to simultaneously move each of the access barriers to a predetermined close position, a predetermined open position, or a predetermined position in between the open or close positions.

17. The system of claim 14, further comprising:

a fume detector configured to be coupled to at least one of said barrier operators; and an alarm configured to be coupled to at least one of said barrier operators, wherein said local transmitter or said network device is configured to invoke an alarm scene mode when said fume detector detects the presence of fumes.

18. The system of claim 17, wherein when said fume detector detects the presence of fumes at least one of said plurality of access barriers is moved to a predetermined position to allow the fumes to escape.

19. The system according to claim 13, said transmitter configured to transmit local signals to control movement of a specific barrier operator.

20. The method of claim 9, further comprising:

invoking with said command buttons an all stop command and at least one of an all open command and an all close command.

21. The system according to claim 3, wherein said at least one appliance is selected from the group consisting of a light, HVAC units, a radio, a coffee maker, a thermostat, door locks, security lights, home alarm systems, an alarm, a carbon monoxide detector, and a fume detector.

22. The system according to claim 3, wherein said transmitter further comprises a first scene button and a second scene button, wherein actuation of said first scene button operatively controls said at least one appliance to a first condition and invokes barrier movement functions at all of said plurality of barriers to adjust each barrier to a close position, an open position or a desired position in between the open and close position, and actuation of said second scene button operatively controls said at least one appliance to a second condition and invokes barrier movement functions at all of said plurality of barriers to adjust each barrier to a close position, an open position or a desired position in between the open and close position, wherein at least one of the barriers is in a different position in said second scene than in said first scene.

23. The method according to claim 20, further comprising:

actuating a first scene button to operatively control said at least one appliance to a first condition and invoke barrier movement functions at all of said plurality of barriers to adjust each barrier to a close position, an open position or a desired position in between the open and close position; and actuating a second scene button to operatively control said at least one appliance to a second condition and invoke barrier movement functions at all of said plurality of barriers to adjust each barrier to a close position, an open position or a desired position in between the open and close position, wherein at least one of the barriers is in a different position in said second scene than in said first scene.

* * * * *